US010773779B2

(12) United States Patent
Birkin

(10) Patent No.: US 10,773,779 B2
(45) Date of Patent: Sep. 15, 2020

(54) CONTROL DEVICE

(71) Applicant: Jeffrey Birkin, Clevedon (GB)

(72) Inventor: Jeffrey Birkin, Clevedon (GB)

( * ) Notice: Subject to any disclaimer, the term of this patent is extended or adjusted under 35 U.S.C. 154(b) by 88 days.

(21) Appl. No.: 16/316,506

(22) PCT Filed: Jul. 11, 2017

(86) PCT No.: PCT/GB2017/052028
§ 371 (c)(1),
(2) Date: Jan. 9, 2019

(87) PCT Pub. No.: WO2018/011560
PCT Pub. Date: Jan. 18, 2018

(65) Prior Publication Data

US 2020/0180739 A1 Jun. 11, 2020

(30) Foreign Application Priority Data

Jul. 11, 2016 (GB) ..... 1612008.1

(51) Int. Cl.
*B63C 9/19* (2006.01)
*B63C 9/00* (2006.01)
(Continued)

(52) U.S. Cl.
CPC ..... *B63C 9/0005* (2013.01); *B63C 9/19* (2013.01); *B63C 9/20* (2013.01); *B63C 9/24* (2013.01);
(Continued)

(58) Field of Classification Search
CPC ..... B63C 9/0005; B63C 9/19; B63C 9/20; B63C 9/24; B63C 2009/0041; B63C 2009/042
See application file for complete search history.

(56) References Cited

U.S. PATENT DOCUMENTS 3,716,882 A 2/1973 Middleton, Jr. et al.
4,560,356 A * 12/1985 Burr ..... B63C 9/08 222/5
(Continued)

FOREIGN PATENT DOCUMENTS

DE 93 03 756.2 6/1993
EP 0 353 956 2/1990
(Continued)

OTHER PUBLICATIONS

International Search Report dated Nov. 2, 2017 in International Application No. PCT/GB2017/052028.
(Continued)

*Primary Examiner* — Stephen P Avila
(74) *Attorney, Agent, or Firm* — Wenderoth, Lind & Ponack, L.L.P.

(57) ABSTRACT

A liquid-ingress control device, comprising a casing having an interior and an exterior, and optionally, a liquid-activated trigger positioned in the casing interior, the casing comprising an exterior liquid entry control surface defined by a perimeter in sealing relationship with an edge of a cap, the cap having an interior cap surface formed to define a cap space between the interior cap surface and the liquid entry control surface; the liquid entry control surface comprising a liquid entry port comprising a tube extending between the exterior and interior of the casing through an aperture formed in the entry control surface, the tube optionally comprising a flange positioned exterior to the casing; the cap comprising at least two flow apertures positioned such that liquid contained within the cap space is capable of egress under gravity from the cap space, independently of the orientation of the device.

20 Claims, 5 Drawing Sheets

(51) Int. Cl.

| | |
|---|---|
| *B63C 9/04* | (2006.01) |
| *B60C 29/00* | (2006.01) |
| *B63C 9/20* | (2006.01) |

(52) U.S. Cl.
CPC ..... *B63C 2009/0041* (2013.01); *B63C 2009/042* (2013.01)

(56) References Cited

U.S. PATENT DOCUMENTS

| | | | | | |
|---|---|---|---|---|---|
| 4,714,914 | A | * | 12/1987 | Boe | G08B 21/088 200/61.04 |
| 4,843,305 | A | * | 6/1989 | Akiba | G01M 3/165 174/11 R |
| 5,027,977 | A | * | 7/1991 | Kay | B63C 9/24 222/5 |
| 5,710,989 | A | | 1/1998 | Flood | |

FOREIGN PATENT DOCUMENTS

| | | |
|---|---|---|
| GB | 2 183 554 | 6/1987 |
| GB | 2485379 | 5/2012 |
| GB | 2552304 | 7/2016 |
| WO | 2015/162425 | 10/2015 |
| WO | 2016/020649 | 2/2016 |

OTHER PUBLICATIONS

Written Opinion of the International Searching Authority dated Nov. 2, 2017 in International Application No. PCT/GB2017/052028.
United Kingdom Intellectual Property Office Search Report, Patents Act 1977: Search Report under Section 17(5) dated Jan. 10, 2017 in corresponding GB application No. 1612008.1.

* cited by examiner

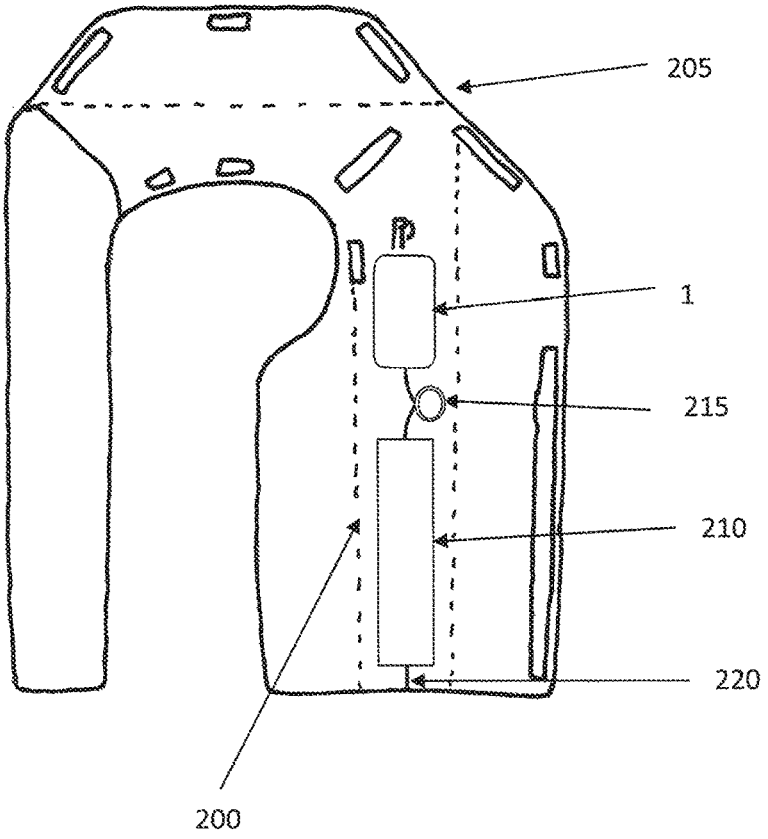
Figure 7
Figure 8
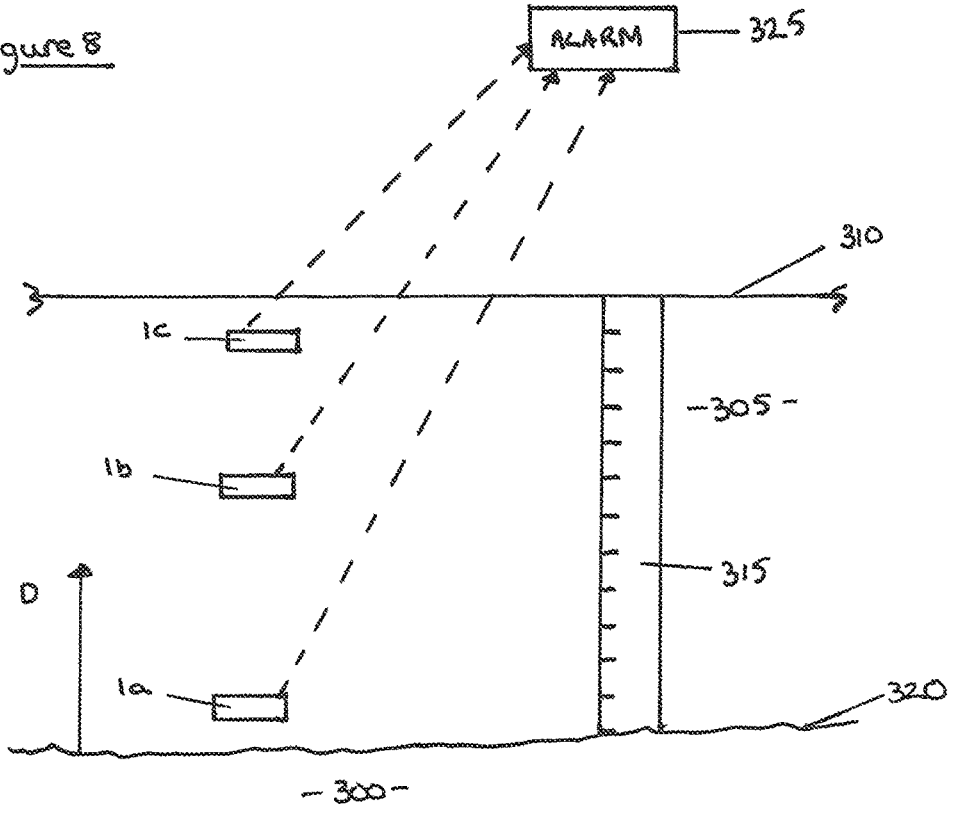

CONTROL DEVICE

FIELD OF THE INVENTION

The invention relates to a system for controlling ingress of a liquid, typically water, into an otherwise sealed container. For example, this may be to control the activation of a liquid-activated trigger mechanism.

BACKGROUND

There are a number of situations in which it might be desirable to control ingress of water into a container until a large amount of water is present. For example, it may be required to have a liquid-activated trigger mechanism for automatic inflation of a life jacket or other maritime life preservation device, for example, or for activation of a flood warning system. In such circumstances, it may also be preferable to protect against activation of the trigger by mere splashing or contact with rain, even where large quantities of water are involved. Ideally, activation of the trigger might be preferred or desirable only in the event of complete immersion of the system.

In the case of a life jacket, in existing systems a steel $CO_2$ container is typically utilised for release of $CO_2$ to rapidly inflate the life jacket. To ensure activation, a metal spring exerts a force of over 200N on a 2-3 mm diameter pin needed to puncture the steel $CO_2$ container. Due to the extremely small space available, in compression this spring is exerting a force of approximately 300N in the 'armed' position. In order to resist this force a solid substance is required to intervene between the spring and surrounding support structure. To allow activation, the solid substance must be able to fail quickly on contact with water. Common substances used are a pellet of compressed dissolvable powder material or a highly compressed paper drum similar to tissue paper. Both, by their very nature, are hydrophilic, so any minor water ingress can result in a fail and subsequent firing. Therefore, servicing at regular intervals is essential if false activation through age is to be avoided. Even with such maintenance, false life jacket inflation is a common occurrence.

Furthermore, due to the need for instant inflation when the wearer enters the water, automatic lifejackets rely on diverting water away from the activator in one direction only, to counteract the effect of rain and spray dripping downwardly in. This means that frequently, if the wearer is sitting and water spray comes up from beneath the wearer, false activation can occur.

In recent years, the introduction of the hydrostatic activation system has prevented many false activations. In these devices, the trigger will not fire until the system is submerged, creating a positive water pressure typically found with a depth of at least 10 cm of water. However, these systems have two main disadvantages. The first is the additional cost of a replacement trigger head, of two and four times the cost of a conventional unit. The second (and more serious) disadvantage is that, if the casualty is wearing buoyant clothing, especially where buoyancy is provided to the lower torso or legs, the activation may be delayed due to an insufficient immersion depth.

The device described in WO2016/020649 is an additional system which may optionally be packed within a lifejacket, which enables easy contact to be made with a person who has fallen overboard from a vessel. A would-be rescuer can make safe initial contact with the victim without jeopardising their own safety, securing the victim to the vessel prior to attempting to bring the victim back on board. One component of this system is a buoyant target element, with which the rescuer first makes contact when executing a rescue manoeuvre. The whole device is packaged within a typical lifejacket, but it may be preferable to deploy the buoyant target element separately from the deployment of the life-jacket itself. Therefore, it is desirable to identify a way of controlling the deployment of this element only when the wearer is immersed in water, rather than accidentally due to contact with waves or rain.

SUMMARY OF THE INVENTION

According to a first aspect of the invention, there is provided a liquid-ingress control device, comprising a casing having an interior and an exterior;

- the casing comprising an exterior liquid entry control surface defined by a perimeter in sealing relationship (or engagement or contact) with an edge of a cap, the cap having an interior cap surface formed to define a cap space between the interior cap surface and the liquid entry control surface;
- the liquid entry control surface comprising a liquid entry port comprising a tube extending between the exterior and interior of the casing through an aperture formed in the entry control surface;
- the cap comprising at least two flow apertures positioned such that liquid contained within the cap space is capable of egress under gravity from the cap space, independently of the orientation of the device.

The liquid may be water and "liquid" and "water" may be used interchangeably herein. However, the liquid is not limited to water. The casing is typically watertight or close to watertight, with the exception of the possible entry of water via the liquid entry port; that is, water can only enter the casing via the liquid entry port. The features of the device are such that a significant amount of water does not enter the interior of the casing unless the device, or at least a region termed the "cap region", comprising the liquid entry control surface and the cap, are submerged in water. Heavy splashing or rain does not result in water entering the interior of the casing, because the features of the liquid entry control surface and the cap prevent this until immersion occurs. This is a result of the inclusion of the liquid entry port tube and the flow apertures in the cap positioned to allow egress of water under gravity, as will be described in more detail below.

The liquid entry control surface may be subdivided into two or more regions, one of which is a port-containing region in which the liquid entry port is positioned. The liquid entry control surface may, for example, be subdivided into three regions, termed a port-containing region, a first flanking region and a second flanking region, the first and second flanking regions being arranged on opposing sides of the port-containing region.

In the device, the liquid entry control surface and/or at least the port-containing region may be substantially planar. Alternatively, the liquid entry control surface may comprise a convex surface (that is, the exterior surface curves away from the interior of the casing). In a further alternative, the liquid entry control surface may comprise a concave surface (the exterior surface curves towards the interior of the casing). The tube may extend from the exterior surface of the casing at substantially about 90° to the surface immediately surrounding the tube. That is, whether the surface is planar or comprises a curved surface, at the point where the tube emerges through the exterior surface of the casing it emerges at substantially a right angle to the immediately surrounding surface. The terms "about 90" and "right angle" in this context may be taken to encompass functional variations, for example, between about 75-105°, or 80-100°, or 85-95°, or about 85°, 86°, 87°, 88°, 89°, 90°, 91°, 92°, 93°, 94° or about 95°.

The liquid entry port tube may be of a length such that it extends away from the liquid entry control surface (i.e., from the exterior of the casing) for at least about 5 mm, for example at least about 6 mm, 7 mm, 8 mm, 9 mm or at least about 10 mm. In an embodiment, the tube further comprises an external flange positioned exterior to the casing. A surface of the flange proximal to the liquid entry control surface may be positioned so that it does not abut the liquid entry control surface. That is, the whole material of the flange may be separated from the material forming the liquid entry control surface by a surface/flange gap. In some embodiments, for example where the device is intended for inclusion within a life jacket and/or within a device as disclosed in WO2016/020649 (incorporated herein by reference, in its entirety), the surface/flange gap may be at least 1 mm, for example at least about 2 mm, 3 mm, 4 mm or at least about 5 mm.

When the device is oriented such that the tube is extending in a generally upwards direction, which might enable water to trickle or flow into the interior of the casing via the liquid entry port were the tube not present, the presence of the tube extending through the liquid entry port has the result that water may not, in fact, run down through the port, until water is present at a sufficient depth to flow over the top of the tube. In an embodiment of the device where the dimensions are small, such as when intended for use within the device described in WO2016/020649, surface tension may result in a build-up of water around and up the tube such that it could reach a sufficient depth to enter the tube, even if the more widely surrounding water depth is not sufficient. Therefore, the presence of the flange provides the further advantage that water must be present in a sufficient quantity to bypass the flange before making progress up to the open end of the tube and thereby enter the interior of the casing. The separation of the flange from the liquid entry control surface by the surface/flange gap provides the yet further advantage that water may pool in the gap and may typically exit the cap space via one or more of the flow apertures, discouraging entry into the interior of the casing.

The flange may be formed by flange material dimensioned such that the flange material distal from the tube (i.e., the material forming its exterior edge) is thinner than the flange material proximal to the tube (i.e., the material of the flange directly next to the tube). A thin or sharp edge forming the exterior edge of the flange encourages water to run off the flange, rather than coalescing on the upper or lower surface. In some arrangements, the thickness of the flange material is tapered, with a gradual reduction in thickness between the flange material proximal to the tube to the flange material distal to the tube.

The tube may be of unitary construction with the material forming the liquid entry control surface, or may be formed separately and inserted through the liquid entry port during assembly of the device. Alternatively or additionally, the flange may be of unitary construction with the material forming the tube, or may be formed as a separate component and positioned around the tube during assembly of the device.

When the device is oriented such that the tube is not extending in a generally upwards direction, water cannot enter the interior of the casing under gravity, by flowing through the liquid entry port via the tube. The tube is also dimensioned such that ingress of the liquid by capillary action is not possible; selection of appropriate dimensions to prevent capillary action is within the routine ability of the skilled person. Liquid entry is, therefore, only possible in the event that the cap space is filled with water such that the water pressure overcomes the air pressure within the device to allow water to move through the tube and enter the interior of the casing. Such a build-up of liquid is discouraged, unless at least the cap region of the device is immersed in water, by way of the features of the cap as described above and in more detail below. In combination, these have the effect that any water contained within the cap space is capable of egress under gravity from the cap space, independently of the orientation of the device. That is, the ability of water to flow out of the cap space is not dependent on whether the device is oriented such that the cap is at the top or bottom of the device, or any other intermediate orientation.

The cap may comprise at least 2, 3, 4, 5 or at least 6 flow apertures. In an embodiment as described in more detail herein, the cap comprises five flow apertures.

In the device, at least one, or more, or all, of the flow apertures may be each formed as a funnel through the material forming the cap, the funnel having an interior mouth and an exterior mouth, the exterior mouth being smaller than the interior mouth. That is, the cross-sectional area of the exterior mouth of the funnel positioned on the exterior of the cap is smaller than the cross-sectional area of the interior mouth of the funnel positioned on the interior of the cap. The cross-sectional area of each funnel may, therefore, gradually decrease along its length between the interior mouth and the exterior mouth of the funnel. This feature makes it more difficult for water to enter than to leave the cap interior. By this method, any water present in the cap interior is encouraged to leave via a flow aperture. When the device has small dimensions as mentioned above, the surface tension of the water discussed above will also encourage egress via the funnel-shaped apertures, as soon as a drop of water contacts an external edge of the interior funnel mouth.

The cap may comprise at least one ridge, each ridge being formed on the interior cap surface (i.e., the interior surface of the cap) and extending between the periphery of a first flow aperture and the periphery of a second flow aperture. The ridge is dimensioned so that the material forming the ridge does not make contact with the liquid entry control surface, so there is a separation between the surface and the material forming the ridge. The ridge, being positioned effectively to link a first flow aperture and a second flow aperture, serves to guide any water present in the cap space on the interior surface of the cap towards one or other of the flow apertures and thereby the exit the cap space. When the dimensions of the cap are small, this may be encouraged by surface tension of any water present, such that any water contacting the ridge will remain in contact with it and will be guided along the material forming the ridge, under the effect of gravity, to exit via one of the flow apertures. This assists in preventing liquid from building where the ridges meet the edge of the cap. Each ridge may be of uniform width or thickness along its length, or may have a base (the material forming the ridge positioned proximal to the interior cap surface) of greater thickness than the spine (the material forming the ridge distal from the interior cap surface). As with the flange, such a narrowing towards the spine of the ridge may encourage water to run along the length of the ridge towards an aperture.

The interior cap surface may be at least partially formed as a concave surface, that is, the interior surface of the cap may curve away from the liquid entry control surface to form a dome. At least a portion of the concave surface may be a circular curve, that is, a portion of a circle. Alternatively, the interior cap surface may be at least partially formed as a portion of an interior surface of a sphere.

The device may further comprise a liquid-activated trigger, for example positioned in the casing interior or operably connected to the casing interior. Water may only contact the liquid-activated trigger by passing into or through the interior of the device casing. Such a device may be termed a "liquid-activated trigger control device" as also discussed elsewhere herein. The trigger may be any water-activated mechanism for any purpose. For example, the trigger may be intended to activate in order to provide a signal of some event, such as a flood, the signal being, for example, a visual, audible or digital signal. For example, water may enter the interior of the casing when the casing is wholly or partially submerged, so that the cap region is submerged, as a result of a certain depth of floodwater having been reached. The entry of the water into the casing interior may, therefore, activate the liquid-activated trigger such that an alarm signal is generated. The trigger may also be configured to cause a physical change in the device, for example a deterioration or disintegration of the casing, as described below in the context of a life-jacket or other water safety device. However, the nature or purpose of the trigger is not critical to the present invention, which relates to the ability to control entry of water into the casing and, in embodiments comprising a trigger, to control activation of a liquid-activated trigger, by providing a system in which the liquid-activated trigger can only be activated in the event that the device is partially or wholly submerged. Any event activated by ingress of liquid into an otherwise sealed container may be controlled by the liquid-ingress control device according to the invention.

When the trigger is referred to as being "operably connected to the casing interior", this indicates that that liquid-activated trigger is positioned elsewhere than in the interior of the casing of the device, but is connected to the casing interior such that, when sufficient liquid enters the casing interior, the liquid-activated trigger is exposed to the liquid such that the trigger is activated. By way of non-limiting example, the trigger may be positioned in the interior of a second watertight casing, linked to the interior of the first casing via a transfer tube. The liquid-ingress control device according to the invention prevents ingress of liquid into the interior of the casing of the device as described herein, until the device is partially or wholly submerged. When the device is so submerged, liquid enters the interior of the device casing and is then transferred via the transfer tube to the interior of the second casing, enabling activation of the liquid-controlled trigger. However, the exact relative arrangement of the liquid-activated trigger relative to the liquid-ingress control device is not critical; the key elements are that the liquid-activated trigger should be in a location which is not exposed to liquid unless and until the liquid-ingress control device is wholly or partially submerged such that sufficient water enters the interior of the casing that the liquid-activated trigger may be activated, by any suitable means.

In an embodiment of the device according to the invention comprising a liquid-activated trigger positioned in the casing interior, the casing may be formed by a first casing portion and a second casing portion, maintained in sealing relationship with one another when the liquid-activated trigger is in an inactivated condition, the trigger comprising a liquid-releasable fixing and the trigger being moveable to an activated condition by contact of the liquid-releasable fixing with a liquid. A tensioned resilient member, such as a helical spring, may be positioned between the first and second casing portions, the tensioned resilient member arranged to force the first casing portion out of sealing relationship with the second casing portion on activation of the trigger (i.e., when the trigger is in an activated condition). Therefore, once the trigger is activated by contact with a liquid such as water, the tensioned resilient member causes the first and second casing portions to move away from one another. Any further items which may be contained within the casing may then be released.

The liquid-releasable fixing may comprise, by way of non-limiting example, polyvinyl acetate (PVA) string or other fixing means formed by PVA, such as a bolt, screw, ribbon or band. A paper- or fabric-based fixing may also be used. However, the exact composition of the liquid-releasable fixing is not critical, provided that the fixing at least partially degrades and/or disintegrates on or soon after contact with liquid, such that it is no longer effective as a fixing.

In this embodiment, prior to activation of the trigger (i.e., when the trigger is in an inactivated condition), the liquid-releasable fixing binds a first attachment means forming part of the first casing portion to a second attachment means forming part of the second casing portion. For example, the first attachment means may be a bar formed on or attached to the interior surface of the first casing portion and this may be tied by PVA string to a bar formed on or attached to the interior surface of the second casing portion, such that the two casing portions are maintained in sealing relationship with one another. The sealing relationship may preferably be complete, such that water ingress into the interior of the casing is only possible via the liquid entry port.

The liquid-activated trigger may also comprise a contact-based system such as an electrical circuit-based system or a conductivity based system. Such a trigger may be activated by disruption of the contact when contacted with a liquid. In such a system, the trigger may be reversibly activated, such that de-activation may occur when liquid is subsequently removed. For example, in the context of a flood alert system as outlined elsewhere herein, this may enable the triggering of an alarm when the device is immersed in water, with the alarm being de-activated or silenced if flood waters recede such that the device is no longer immersed in water, as water is able to drain from the interior of the device.

The casing may be substantially elongate and the liquid entry control surface and cap positioned at a first end of the casing. Such an arrangement may be referred to herein as an "elongate device according to the invention".

In an exemplary embodiment of the device, which may be suitable, for example, for use within a life jacket or, more particularly, within a device as described in WO2016/020649 (although this embodiment may also be suitable for other uses), the device may be substantially elongate and may comprise a first liquid entry control surface and a first cap positioned at a first end of the casing, and a second liquid entry control surface and a second cap positioned at a second end of the casing. The first end of the casing may also comprise a third liquid entry control surface and a third cap and/or the second end of the casing may also comprise a fourth liquid entry control surface and a fourth cap. Any of these arrangements may be referred to herein as a "double-ended elongate device according to the invention".

The edge of the first cap may comprise a linear edge portion positioned distally from a first end of the casing, and a curved edge portion positioned proximally to the first end of the casing, the curved edge portion having a first end linked to the linear edge portion by a first side edge and a second end linked to the linear edge portion by a second side edge. That is, the edge of the first cap which is closest to the first end of the casing forms a curve, whilst the edge of the first cap which is positioned away from the first end of the casing is formed substantially as a straight line. The edges form a generally semi-circular shape, although the curved portion need not be mathematically circular in shape. The first and second side edges, when the first cap is in sealing engagement with the first liquid entry control surface, may contact the port-containing region of the liquid entry control surface as described above and in more detail below. The linear edge portion may contact a first flanking region located at an end of the device and the curved edge portion may contact a second flanking region positioned on an opposing side of the port-containing region to the first flanking region.

The properties discussed above in the preceding paragraphs in relation to the first cap are replicated in the second, third and fourth caps, when present, the features interacting with equivalent portions of the first or second ends, as applicable according to the location of the cap. Therefore, any description herein of the features of the first cap should be understood as also being features of the second and/or third and/or fourth caps, when present.

The or each cap may comprise a first and a second flow aperture, both positioned at or close to the linear edge portion of the cap. By "at or close to", in any description herein of the positioning of a flow aperture, is meant that a flow aperture may be positioned within the edge of the cap, such that when the cap is disassembled from the device, the aperture is in the form of an indentation in the edge, the aperture being fully formed once the edge of the cap is contacted with the perimeter of a liquid entry control surface. Alternatively, the aperture may be fully formed through the material forming the cap, the aperture being positioned close to but not at the edge of the cap. In either arrangement, the position of the aperture is at the linear edge.

The or each cap may comprise at least a third flow aperture, positioned at or close to the curved edge portion of the cap. The or each cap may comprise a third flow aperture positioned at or close to the first end of the casing and a fourth flow aperture positioned at or close to the first side edge and a fifth flow aperture positioned at or close to the second side edge. This arrangement of flow apertures provides the advantage that water is always able to exit the cap space, regardless of the orientation of the device with reference to the vertical and horizontal. This advantageously assists in preventing water ingress into the interior of the casing of the device if the device experiences significant splashing or heavy rain, so that water ingress only occurs in the event that the device is partially or wholly submerged in water. In the context of an elongate device according to the invention, submersion of the end cap region of the device, including the whole of the cap arrangement, may be sufficient to cause the water ingress required to activate the liquid-activated trigger. In the context of a double-ended elongate device according to the invention, submersion of a single end cap region of the device, including a whole cap arrangement, may be sufficient. Complete immersion of the whole device may, however, be preferred.

In a cap which comprises a first, second and third flow aperture as described above, the cap may comprise a first ridge formed on the interior surface of the cap and extending between the periphery of the first flow aperture and the periphery of the third flow aperture, and may further comprise a second ridge formed on the interior surface of the cap and extending between the periphery of the second flow aperture and the periphery of the third flow aperture. The first and second ridges preferably do not intersect or otherwise abut one another.

In any embodiment of the device, any or all of the liquid entry control surface, the liquid entry port tube, the flange and/or the cap may be formed from and/or coated by any material having a low energy surface which encourages liquid flow, such as a metal or plastics material. Rigid or substantially rigid materials may be preferred, i.e., materials that resist deformation. Polypropylene may be a particularly suitable material, or high performance polyamide. The exact material is not critical, although it is preferred that is should form surfaces which are smooth, to discourage pooling or collecting of liquid and encourage egress from the cap space. The material(s) may be selected by the skilled person, without application of inventive skill, according to the nature of the liquid with which it is intended to activate the trigger.

A related second aspect of the invention provides a liquid-activated trigger control device, comprising a casing having an interior and an exterior, and a liquid-activated trigger positioned in the casing interior;

the casing comprising an exterior liquid entry control surface defined by a perimeter in sealing relationship (or engagement or contact) with an edge of a cap, the cap having an interior cap surface formed to define a cap space between the interior cap surface and the liquid entry control surface;

the liquid entry control surface comprising a liquid entry port comprising a tube extending between the exterior and interior of the casing through an aperture formed in the entry control surface, the tube comprising a flange positioned exterior to the casing;

the cap comprising at least two flow apertures positioned such that liquid contained within the cap space is capable of egress under gravity from the cap space, independently of the orientation of the device. Any or all of the features mentioned in relation to the second aspect of the invention may be as described in relation to the first aspect of the invention.

According to a third aspect of the invention, there is provided a man overboard rescue assistance device comprising a liquid-ingress control device according to the first aspect of the invention or a liquid-activated trigger control device according to the second aspect of the invention. The man overboard rescue assistance device may be as described in WO2016/020649. However, it may be any other rescue assistance device such as that described (by way of non-limiting example) in WO2015/162425.

For example, the man overboard rescue assistance device may comprise at least one object attachment point, for attaching the device to the object, and at least one inflatable and/or buoyant target mesh element, the attachment point and target mesh element being linked by, or having arranged between them, at least one extendible line portion which is extendible only when placed under longitudinal pressure or force, the target mesh element being contained in the interior of the casing of a device according to a first or a second aspect of the present invention. The extendible line portion may be caused to extend to extended form, in use, by pulling both ends of the line away from one another, or by maintaining one end of the line at a fixed point and pulling the other end of the line. The use of such a man overboard rescue assistance device is described extensively in WO2016/020649, which is incorporated herein by reference in its entirety.

The target mesh element is convertible between an undeployed state within the casing of a device according to the invention, to a deployed state after the activation of the liquid-activated trigger, the target mesh element comprising an inflatable and/or buoyant portion or portions. The trigger of the present invention may comprise means for inflation of the inflatable portion or portions, where present. This embodiment of the rescue assistance device may comprise an elongate device according to the invention or a double-ended elongate device according to the invention.

The target mesh element may form the shape of a triangle or circle, or any other shape which assists in maintaining the target mesh element in an "open" configuration on the surface of the water.

The extendible line portion may be a packaged length of lifting line, formed as a package such that each end of the line emerges from the package at a different point, wherein the extendible line portion remains in packaged form unless and until a longitudinal force is applied to one or both ends of the line. The package may be essentially cylindrical or "sausage-shaped". One end of the line preferably emerges from the cylindrical package at one end and the other end of the line emerges from the other end of the package.

The extendible line portion forms a link between, or joins, the target mesh element and the object attachment point. The object attachment point may be, for example, a D-ring, O-ring, loop of rope or webbing, or any other suitable connection means, to which one end of the line included within or forming the extendible line portion may be attached via a knot or a more permanent fixing such as a stitched fixing. The device according to the third aspect of the invention may further comprise a winch connection point providing means for connecting the rescue assistance device to a winch mechanism, the connection point being positioned between the target mesh element and the end or end region of the extendible line portion proximal to the target mesh element.

A fourth aspect of the invention provides a buoyancy aid comprising a device according to the first or second aspects of the invention, or comprising a man overboard rescue assistance device according to the third aspect of the invention. The buoyancy aid may be a lifejacket, Lifesling®, life raft or other buoyancy or rescue aid, by way of non-limiting example.

The inclusion of a device according to the third aspect of the invention within a buoyancy aid, particularly (but not limited to) a device as described in WO2016/020649 comprising a device according to the first or second aspects of the present invention, is that the man overboard rescue assistance device can be deployed separately from and after the deployment of the buoyancy aid. This may be especially advantageous where the buoyancy aid is an automatically inflated life jacket. The life jacket may deploy immediately on contact with the water, releasing the man overboard rescue assistance device from the material of the lifejacket. Due to the resulting immersion of the device according to the invention, the liquid-activated trigger is activated and, in an embodiment, causes the casing to at least partially disintegrate (for example by enabling two casing portions to separate from one another) such that a component located in the interior of the casing, such as the target mesh element described above and in WO2016/020649, or the floatable rope described in WO2015/162425, is released into the water for engagement by a rescuer. This carries the advantage that the deployment of these rescue assistance device elements is separate from, and cannot hinder or be hindered by, deployment of the lifejacket itself.

A fifth aspect of the invention provides a flood alert system comprising a device according to the first or second aspects of the invention. In an embodiment, the flood alert system may comprise two or more devices according to the first or second aspects of the invention, or a combination thereof, including a first device positioned at a position at which is desirable, if flood water should reach that position, that an alarm should be raised. A second or further device according to either of the first or second aspects may be positioned at a second or further position at which, if a first alarm has been triggered via the first device, a second or further alarm should also be triggered if flood water should also reach that position. For example, successive devices may be positioned in vertical relationship to one another, or may be placed further upstream or downstream if the flooding of a river or other flowing waterway is intended to be monitored. A device intended for this purpose may include digital signal generating means, which provide a digital signal in the event of activation of the trigger. Such a device may also comprise one or more solar cells, for example positions on an exterior surface of the casing, to provide power to the digital signal generating means. This enables such a device to be unitary and self-sufficient, without need for attachment to external power sources, which may be advantageous in poorer and/or more remote locations.

Throughout the description and claims of this specification, the words "comprise" and "contain" and variations of the words, for example "comprising" and "comprises", mean "including but not limited to" and do not exclude other components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Preferred features of each aspect of the invention may be as described in connection with any of the other aspects. Generally speaking the invention extends to any novel one, or any novel combination, of the features disclosed in this specification (including any accompanying claims and drawings). Thus, features, integers or characteristics, described in conjunction with a particular aspect, embodiment or example of the invention are to be understood to be applicable to any other aspect, embodiment or example described herein, unless incompatible therewith. Moreover, unless stated otherwise, any feature disclosed herein may be replaced by an alternative feature serving the same or a similar purpose.

BRIEF DESCRIPTION OF DRAWINGS

Embodiments of the invention will now be described with reference to FIGS. 1-8 below, in which:

FIG. 7 shows a lifejacket comprising a device as described in WO2016/020649, comprising the device of FIG. 1; and FIG. 8 shows a schematic arrangement of devices as shown in FIG. 1, when used in a flood alert system.

DETAILED DESCRIPTION

Figure 1:
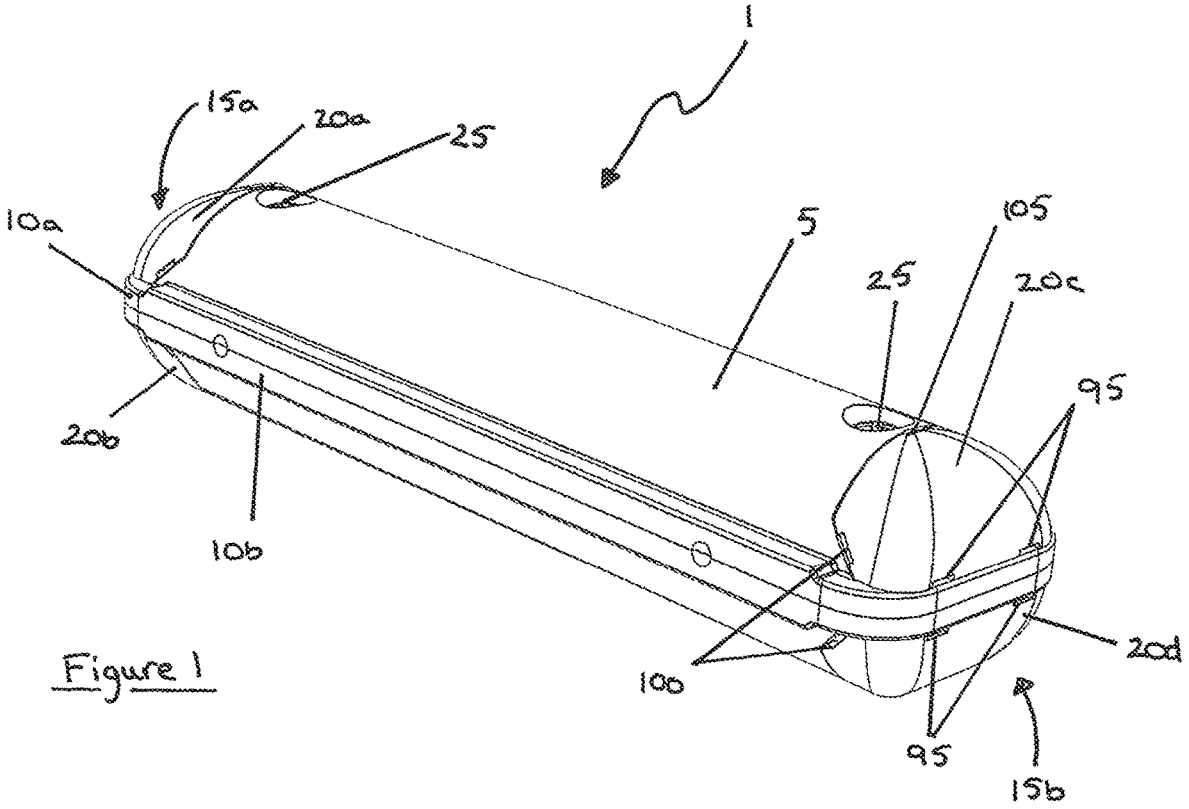
FIG. 1 shows a device according to the invention in assembled form.

FIG. 1 shows a device 1 according to the invention comprising a casing 5 formed from two halves 10*a* and 10*b*. The casing is approximately 140 mm in length, approximately 40 mm in width and approximately 32 mm in depth The casing has two ends 15*a* and 15*b* each having two caps 20*a*, 20*b*, 20*c*, 20*d*. Caps 20*a* and 20*b* are located at end 15*a* and caps 20*c* and 20*d* are located at end 15*b*. Caps 20*a* and 20*c* are engaged with casing half 10*a* and caps 20*b* and 20*d* are engaged with casing half 10*b*. Each cap is approximately 32 mm wide. Recesses for fixings 25, such as screws, involved in assembling the casing halves 10*a* and 10*b* to form casing 5 are also visible.

Figure 2:
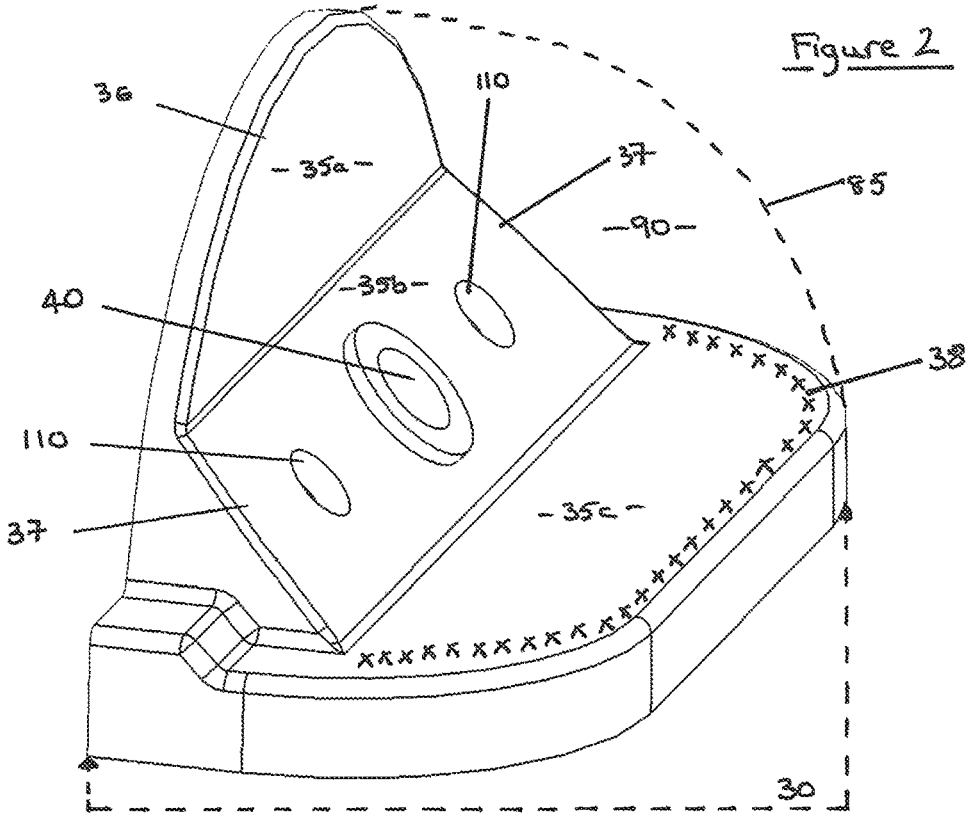
FIG. 2 shows an end region of the device of FIG. 1 in disassembled form.

FIG. 2 shows casing half 10*a* at end 15*b* with cap 20*c* removed. The exterior surface of the casing end region indicated as 30 (known as the "cap region" when the cap is in position), has three main sections, a vertical section 35*a*, an inclined section 35*b* and a horizontal section 35*c*. A liquid entry port is formed as an aperture in the material of section 35*b* and is shown as 40, through which water may enter the interior of the casing 5. The internal diameter of the port is approximately 3 mm.

Figure 3:
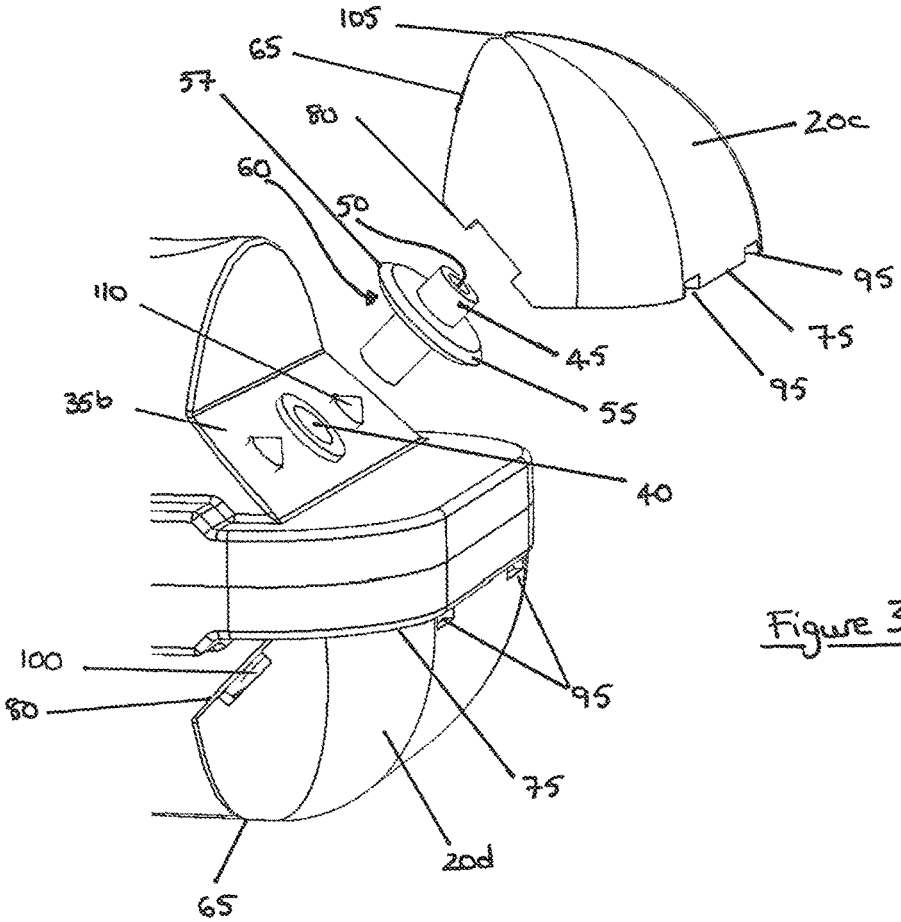
FIG. 3 shows an exploded view of an end region of the device of FIG. 1.

FIG. 3 shows an exploded view of the casing 5 at end 15*b* with cap 20*c* removed and cap 20*d* in position on the device. The liquid entry port 40 is shown ready to receive a tube 45 comprising a flange 55, having a sharp edge 57. The exterior diameter of the tube is approximately 3 mm and the diameter of the flange is approximately 8 mm. When inserted into the liquid entry port 40, the exterior surface of the tube 45 forms a sealing relationship with the interior surface of the port 40, so that water can only progress through the port 40 via the mouth 50 of the tube 45. The internal diameter of the tube is approximately 2 mm. The tube 45 is inserted into the port 40 such that the lower surface 60 of the flange 55 does not make contact with the inclined section 35*b* (or the neighbouring surfaces 35*a* and 35*c*). Therefore, a space is maintained under the flange surface 60, between the material of the flange 55 and the surface 35*b*, so that water may be present in this space without the possibility of surface tension causing water to progress up to the mouth 50 of the tube 45, where it could enter the interior of the casing 5 via the port 40. In the particular embodiment described here, there is typically approximately 3 mm between the surface 35*b* and the flange surface 60.

Figure 4A:
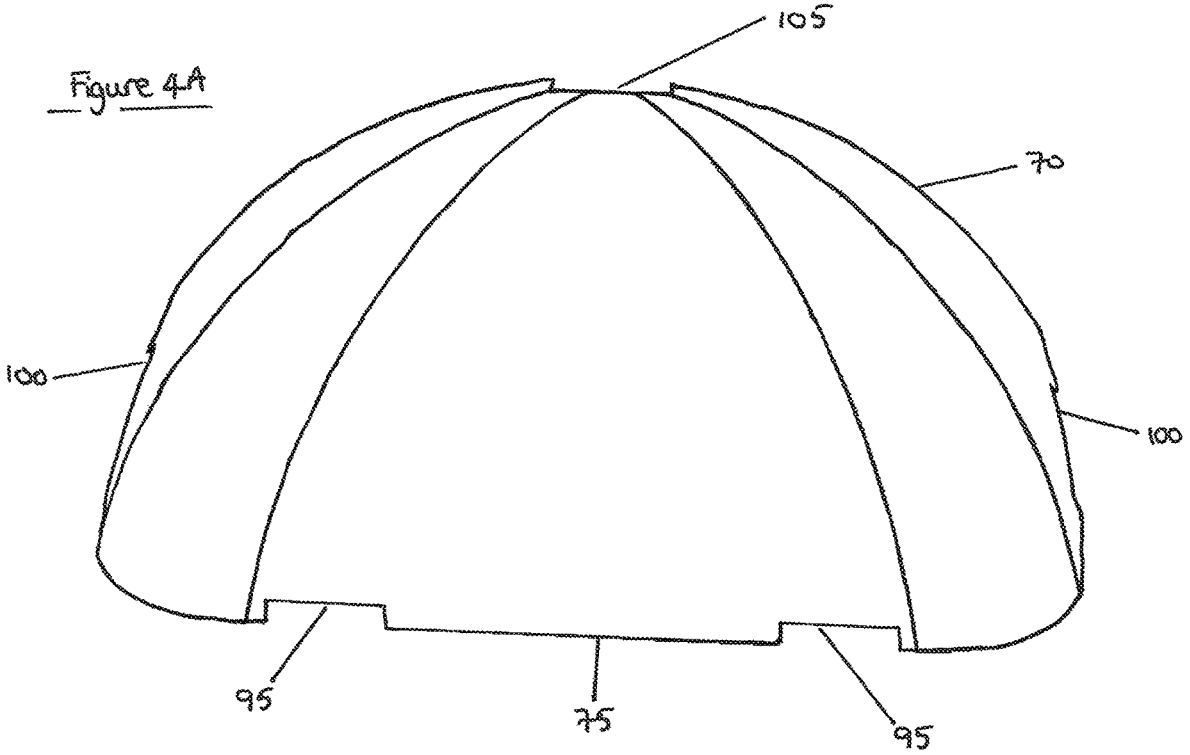
FIG. 4 shows a plan view (FIG. 4A) and a perspective view (FIG. 4B) of a cap for inclusion in the device of FIG. 1.

The cap 20*c* has an edge 65, comprising a curved edge 70 and a linear edge 75 (see also FIG. 4A). The linear edge 75 is joined to the curved edge 70 by joining edge 80. Equivalent edges on cap 20*d* are also indicated in FIG. 3. When the edge 65 of the cap 20*c* is in contact with the exterior surface of the casing end region, a sealing relationship is formed so that water may not readily access the mouth 50 of the tube 45 extending through the liquid entry port 40. The dotted line 85 in FIG. 2 is a schematic indication of the exterior surface of the cap 20*c* when sealingly engaged in position, defining the cap space 90 between the exterior surface of the casing end region and the interior surface of the cap. The maximum distance between the interior surface of the cap and the surface 35*b* is approximately 10 mm. The internal volume of the cap space, in the embodiment described here, is typically less than about 2 ml.

The features marked 110 in FIGS. 2 and 3 are fixing points to enable sealing engagement between the cap and the casing end region. These may be fixing means such as a screw engaged from the outside of the cap through to the material forming the casing end region, or may be a simple "clip" feature such as shown in FIG. 3, in which a protrusion 110 from the material forming the casing end region may frictionally engage with an engagement feature 112 such as a recess formed in the interior material of the cap (see FIG. 5).

In FIGS. 1, 2 and 3, flow apertures may be observed on caps 20*c* and 20*d*, with end apertures 95, side aperture 100 and top aperture 105. Aperture 100 is formed at the edge of the cap, in joining edge 80, which engages with the surface 35*b*. Such an aperture is formed on both sides of the cap, as shown in FIG. 4A. The relative positioning of the various apertures ensures that, not matter what the orientation of the device, there is always at least one aperture positioned such that water may flow under gravity out of the cap space. The inventor has found this arrangement of five flow apertures to be optimal for achieving this.

Figure 4B:
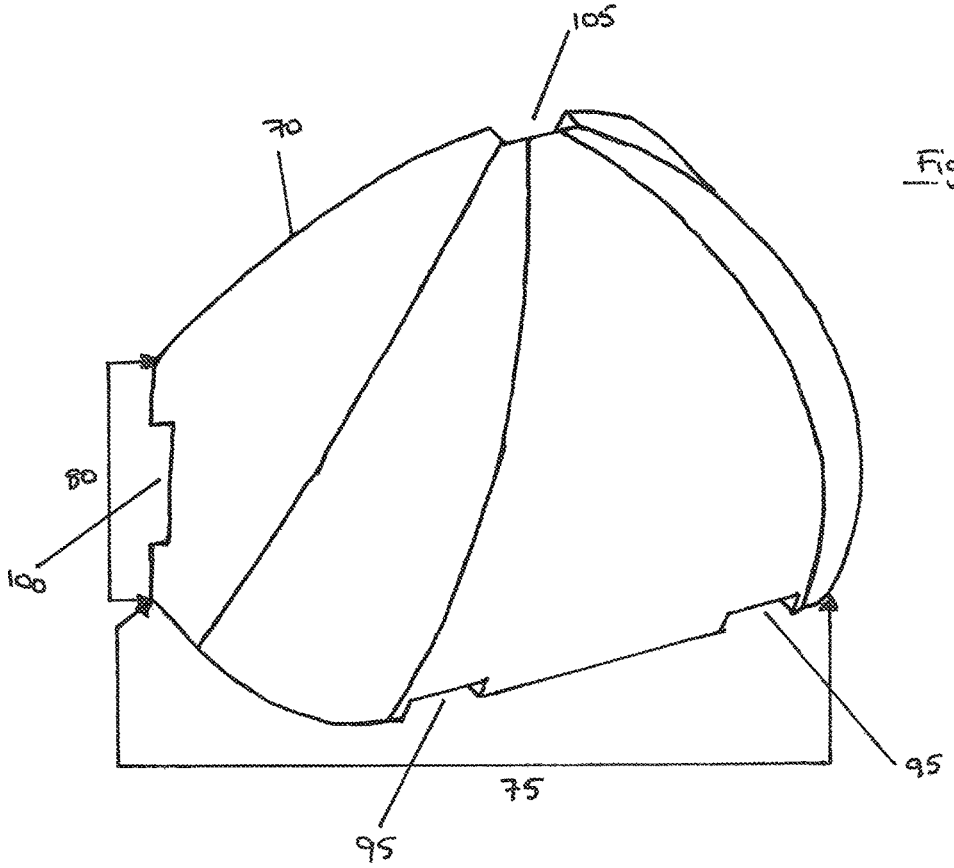

FIGS. 4A and 4B show exterior views of the cap. The curved edge 70, linear edge 75 and joining edges 80, together forming cap edge 65, may be observed, with apertures 95, 100 and 105 formed as recesses in the edge of the cap. The recesses are approximately 3-4 mm across and approximately 1 mm deep. When the cap is positioned so that the edge 65 contacts the exterior surface of the casing end region, the flow apertures are completed. The curved edge 70 makes contact with the curved perimeter 36 of the surface 35*a*. The joining edge 80 makes contact with the side 37 of surface 25*b*. The linear edge 75 makes contact with the casing exterior edge 38 of the surface 35*c*, at the region shown schematically by xxx in FIG. 2.

In an alternative embodiment not illustrated here, surfaces 35*a*, 35*b* and 35*c* may each or all form a concave curve, in which case the shape and dimensions of the cap edge 65 may be adjusted accordingly. In one example, surface 35*c* may remain as shown, but surfaces 35*a* and 35*b* may form a single concave curve. Likewise, an arrangement involving one or more convex curves may be contemplated. Variations to the exact arrangement of this region of the device may be contemplated by the skilled person and are not critical to the working of the invention.

Figure 5:
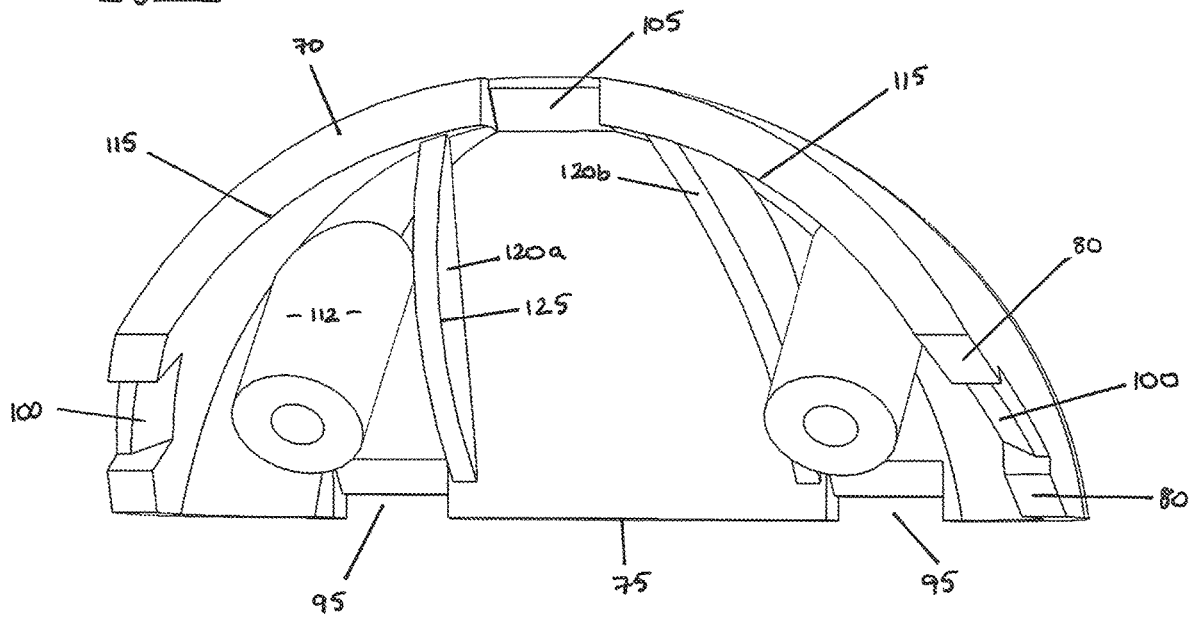
FIG. 5 shows an interior view of the cap.

FIG. 5 shows the structure of the interior of a cap. The interior surface 115 of the cap is generally formed as a smooth, curved surface, to reduce "dew points" on which water may gather. This view of the cap interior shows ridges 120*a* and 120*b*, each extending between the edge of the aperture 105 and one of the apertures 95. The top surface 125 of each ridge is formed as a convex curve relative to the longitudinal axis of the ridge, this shape assisting in encouraging water to move towards one end or the other of the ridge (depending on the orientation of the device) and then to exit the cap space via the aperture at the end of the ridge. Each ridge has a thickness of approximately 0.5-1 mm and a maximum depth of approximately 2-3 mm. The inventor has found that the presence of the ridges greatly encourages the egress of water which has entered the cap space as a result of splashing or of heavy rain landing on the device, such that water does not build up in the cap space to enter the tube 45 via the tube mouth 50. Water entry into the interior of the casing 5 is thereby discouraged.

FIG. 5 also enables visualisation of the funnel structure of the flow apertures 95, 100 and 105. For example, at the bottom left of FIG. 5, it can be seen that the aperture 100 is formed such that the cross-sectional area of the aperture opening at the interior surface is greater than the cross-sectional area of the aperture opening at the exterior surface. Therefore, the aperture forms a funnel having a larger mouth at the interior of the cap compared to the mouth at the exterior. This feature makes it more difficult for water to enter than to leave the cap interior. By this method, any water present in the cap interior is encouraged to leave via a flow aperture.

Figure 6:
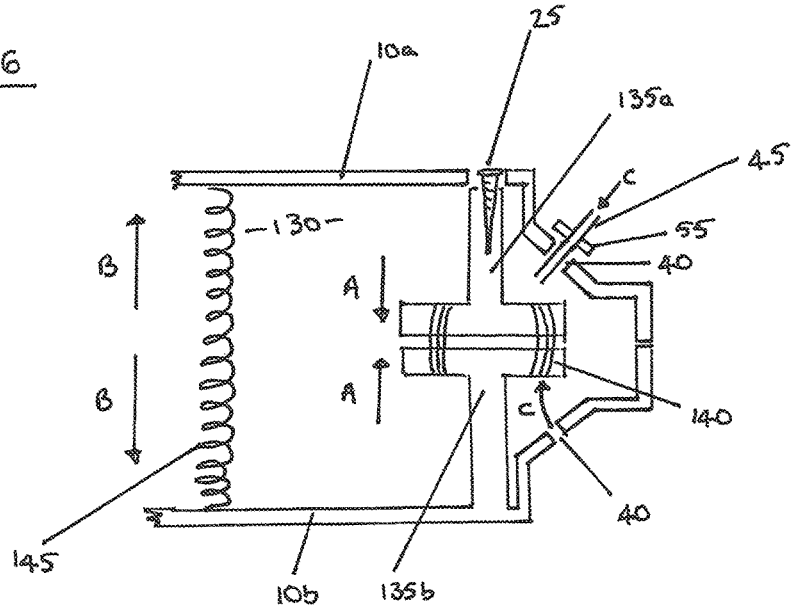
FIG. 6 shows a cross-sectional view of a section of the device of FIG. 1 prior to ingress of water.

FIG. 6 shows a portion of the interior construction of the casing 5, with casing halves 10*a* and 10*b* defining the interior 130. T-bars 135*a* and 135*b* are forced together in the direction of the arrows A by the action of the PVA string 140 which binds the T-bars together. This counteracts the effect of the spring 145 which is positioned between casing halves 10*a* and 10*b* and is tensioned so as to tend to force the halves apart in the direction of the arrows B; this movement is, therefore, prevented so long as the force in the direction of the arrows A is maintained by the presence of the PVA string 140. Screw 25 extends into T-bar 135*a* from the exterior of casing half 10*a*, to enable assembly of the device with the PVA string intact.

When water is able to enter the interior 130 in the direction of the arrows C, via the tube 45 which extends through the entry port 40 (shown with the tube present for the casing half 10*a* and with the tube absent for the casing half 10*b*), the relative location of the tube 45, the T-bar 135*a* and the PVA string 140 has the effect that water is directed to make contact with the string. On contact with water, the string dissolves, enabling the action of the spring 145 to force the casing halves 10*a* and 10*b* apart in the direction of the arrows B. This releases any item(s) which may be packaged or contained in the interior 130, or in some trigger arrangements, may activate an alarm. For example, an electrical contact may be maintained between the adjoining surfaces of the T-bars 135*a* and 135*b* such that, when the electrical contact is broken, a digital signal is generated for communication with an exterior detection device. The forcing apart of the casing halves 10*a* and 10*b* would cause such a break in this electrical contact, notifying the detection device that water has entered the interior of the device; this may, for example, trigger an alarm.

The presence of the various features within the device shown in FIGS. 1-6 has the effect described as follows. Water is generally unable to enter the interior of the device casing, which contains the water-activated trigger (such as a casing destruction mechanism as described in FIG. 6). The only access point for water is via the tube 45 located in the port 40. In order to ensure that the trigger is not activated when the device is heavily splashed, or contacted with heavy rain, but is only activated when the device is submerged, various features act to either discourage the entry of water into the casing interior, or to encourage exit of water from the cap space.

The entry of water into the casing interior is made more difficult by the presence of the tube 45 extending through the port 40. This means that water must access the tube mouth 50 before being able to enter the port 40, rather than being able to trickle down through the port 40. The further addition of the flange or ring 55, positioned so that there is a gap between its underside 60 and the device surface 35*b*, provides a further hurdle which any water must overcome before it may enter the mouth 50 of the tube 45. The presence of the flange 55 and tube 45 encourages any water present to spread out across the surface 35*b*, rather than entering the port 40.

The presence of the apertures 95, 100 and 105 enables any such water gathering in the cap space to leave the cap space under the action of gravity, regardless of the orientation of the device. If the device is in the orientation shown in FIG. 3, for example, water may exit via apertures 95 and 100 in the cap 20*c*, or from aperture 105 in cap 20*d* (not visible in this Figure). If the device is turned so that an end is directed downwards, water may exit via apertures 95. In intermediate directions, water may exit via a combination of apertures depending on the action of gravity and any surface tension which may cause small amounts of water to coalesce. The interior surface of the cap being formed as a concave curve assists with encouraging water to collect at the locations closest to the apertures and the apertures are positioned to take advantage of this. Furthermore, the presence of the ridges on the interior surface of the cap further serves to encourage any water present to move towards one or more apertures. Finally, the funnel shape of the apertures, with the exterior mouth smaller than the interior mouth, makes it more difficult for splashed water or rain to enter the cap space in the first place, whilst also making it easier for any water which is present in the cap space to leave.

If the tube 45 is orientated so that it is positioned vertically, with the tube mouth 50 directed downwards, the vertical distance between the mouth 50 of the tube and the interior surface of the cap 20 is the smallest possible. Therefore, in this orientation, it is more likely for water to be present in the cap interior to a depth to contact the mouth 50 of the tube. However, the tube 45 is dimensioned such that upwards entry of water through the mouth 50 of the tube as a result of capillary action is not possible, so that water cannot enter unless the tube 45 is moved towards the horizontal position (or the device is so inundated with water by immersion that the features discouraging water entry are overwhelmed). As the orientation of the device moves the tube 45 toward the horizontal position, water flows away from the mouth 50 of the tube into the other regions of the cap, quickly draining from the ports 95, 100 and 105.

These combined features prevent or reduce the occurrence of water entering the casing interior unless and until at least a casing end region, if not the whole device, is immersed in water. This effect has been demonstrated on repeated occasions by the inventor. The pressure from immersion in water overcomes the effect of the various features described above and "swamps" the cap space, thereby enabling water to access the mouth 50 of the tube 45 and so to enter the casing interior via the port 40. This enables the activation of the liquid-activated trigger located within the casing, for example, as described above in relation to the embodiment shown in FIG. 6.

FIG. 7 shows a device 200 as described in WO2016/020649 in position within a lifejacket 205. The attached packaged lifting line 210 and lifting ring 215 are shown attached to a device 1 according to the present invention, as shown in FIGS. 1-6, the device also comprising the target mesh element within the interior of the device casing, which is deployed so that a rescuer can make safe contact with a man overboard victim. The device 200 is secured to the lifejacket by an end of the lifting line at point 220.

FIG. 8 provides a schematic representation of a flood alert system comprising a device as described herein. A river 300 may be enclosed by a bank 305 having a top surface 310. Such a bank may have a traditional depth indicator 315 fixed to it, to provide a visual indication of whether the surface 320 of the river 300 is rising in the direction of the arrow D. However, such indicators to not provide any automatic signal to authorities to alert them to a rising river and this may be of particular interest, for example, at night or on waterways prone to rapid and catastrophic flooding. Therefore, one or more devices 1 according to this invention may also be positioned at one or more positions on the bank 305. Lowest positioned device 1*a* may provide an alert when the surface 320 of the river 300 starts to rise in the direction of arrow D, with the next positioned device 1*b* providing an indication of a more dangerous depth change and the topmost positioned device 1*c* providing a warning of an imminent catastrophic flood which may cause the river to burst its banks. In the case of a rapidly developing flood, such a system may assist authorities in preparing surrounding communities and/or to evacuate people from the area. In such an arrangement, the interior of the casing of each device 1 comprises a system which is activated on activation of the liquid-activated trigger, this system being, for example, an audible alarm or a digital signal which is transmitted to an alarm system 325. Such a digitally-based system might be especially useful in more remote and/or poorer parts of the world, where the ability to notify central authorities to an unfolding flood event, without any requirement for sophisticated or expensive equipment, might be highly beneficial. The device 1 may comprise one or more solar cells on an exterior surface, to provide power to a means for generating a required digital signal, on activation of the trigger.

The invention claimed is:

1. A liquid-ingress control device, comprising a casing having an interior and an exterior;

the casing comprising an exterior liquid entry control surface defined by a perimeter in sealing relationship with an edge of a cap, the cap having an interior cap surface formed to define a cap space between the interior cap surface and the liquid entry control surface;

the liquid entry control surface comprising a liquid entry port comprising a tube extending between the exterior and interior of the casing through an aperture formed in the entry control surface;

the cap comprising at least two flow apertures positioned such that liquid contained within the cap space is capable of egress under gravity from the cap space, independently of the orientation of the device.

2. A device according to claim 1 wherein at least a portion of the liquid entry control surface is substantially planar.

3. A device according to claim 1 wherein the tube extends from the exterior of the casing at substantially 90° to the surface surrounding the tube.

4. A device according to claim 1 wherein the tube comprises a flange positioned exterior to the casing, wherein a surface of the flange proximal to the liquid entry control surface does not abut the liquid entry control surface.

5. A device according to claim 1 wherein the cap comprises at least 3, 4, 5 or at least 6 flow apertures.

6. A device according to claim 1 wherein at least one, or more, or all, of the flow apertures is each formed as a funnel through the material forming the cap, each funnel having an interior mouth and an exterior mouth, the exterior mouth being smaller than the interior mouth.

7. A device according to claim 1 wherein the cap comprises at least one ridge, each ridge being formed on the interior cap surface and extending between the periphery of a first flow aperture and the periphery of a second flow aperture.

8. A device according to claim 1, wherein the interior cap surface is at least partially formed as a concave curve.

9. A device according to claim 1, further comprising a liquid-activated trigger, wherein the liquid-activated trigger is positioned in the casing interior or is operably connected to the casing interior.

10. A device according to claim 1 comprising a liquid-activated trigger positioned in the casing interior, wherein the casing is formed by a first casing portion and a second casing portion, maintained in sealing relationship with one another by the liquid-activated trigger in an inactivated condition, the trigger comprising a liquid-releasable fixing and the trigger being moveable to an activated condition by contact of the liquid-releasable fixing with a liquid.

11. A device according to claim 10 wherein, when the trigger is in an inactivated condition, the liquid-releasable fixing binds a first attachment means forming part of the first casing portion to a second attachment means forming part of the second casing portion.

12. A device according to claim 10 wherein a tensioned resilient member is positioned between the first and second casing portions, the tensioned resilient member arranged to force the first casing portion out of sealing relationship with the second casing portion when the trigger is in an activated condition.

13. A device according to claim 1 wherein the casing is substantially elongate and the liquid entry control surface and cap are positioned at a first end of the casing.

14. A device according to claim 13 wherein the edge of the cap comprises a linear edge portion positioned distally from the first end of the casing, and a curved edge portion positioned proximally to the first end of the casing, the curved edge portion having a first end linked to a first end of the linear edge portion by a first side edge and a second end linked to a second end of the linear edge portion by a second side edge.

15. A device according to claim 14 wherein the cap comprises a first and a second flow aperture, both positioned at or close to the linear edge portion of the cap.

16. A device according to claim 14 comprising a third flow aperture positioned at or close to the first end of the casing and a fourth flow aperture positioned at or close to the first side edge and a fifth flow aperture positioned at or close to the second side edge.

17. A device according to claim 16, wherein the cap comprises at least one ridge, each ridge being formed on the interior cap surface and extending between the periphery of a first flow aperture and the periphery of a second flow aperture, comprising a first ridge extending between the periphery of the first flow aperture and the periphery of the third flow aperture, further comprising a second ridge extending between the periphery of the second flow aperture and the periphery of the third flow aperture.

18. A liquid-activated trigger control device, comprising a device according to claim 1 and a liquid-activated trigger positioned in the casing interior.

19. A man overboard rescue assistance device comprising a liquid-ingress control device according to claim 1.

20. A buoyancy aid comprising a liquid-ingress control device according to claim 1.

* * * * *